US005687140A

United States Patent [19]

Sekine et al.

[11] Patent Number: 5,687,140

[45] Date of Patent: Nov. 11, 1997

[54] TIMEPIECE AND ITS DISPLAY SWITCHING MECHANISM

[75] Inventors: Kiyose Sekine; Tetsushi Asao, both of Tokyo, Japan

[73] Assignee: Orient Watch Company Limited, Tokyo, Japan

[21] Appl. No.: 387,724

[22] PCT Filed: Jun. 9, 1994

[86] PCT No.: PCT/JP94/00937

§ 371 Date: Feb. 16, 1995

§ 102(e) Date: Feb. 16, 1995

[87] PCT Pub. No.: WO95/00888

PCT Pub. Date: Jan. 1, 1995

[30] Foreign Application Priority Data

Jun. 17, 1993 [JP] Japan ..... 5-171009
Jun. 18, 1993 [JP] Japan ..... 5-172615

[51] Int. Cl.[6] ..... G04B 19/16

[52] U.S. Cl. ..... 368/231

[58] Field of Search ..... 368/231, 80

[56] References Cited

U.S. PATENT DOCUMENTS

| | | | |
|---|---|---|---|
| 355,461 | 1/1887 | Morton | 368/231 |
| 374,605 | 12/1887 | Lewis | 368/231 |
| 395,696 | 1/1889 | Ethridge | 368/231 |
| 403,338 | 5/1889 | Fischer | 368/231 |
| 1,424,195 | 8/1922 | Demko et al. | 368/231 |
| 3,404,527 | 10/1968 | Tripet et al. | 368/231 |

FOREIGN PATENT DOCUMENTS

| | | |
|---|---|---|
| 450476 | 11/1912 | France . |
| 453216 | 6/1968 | France . |
| 37-894 | 1/1962 | Japan . |
| 51-149666 | 11/1976 | Japan . |
| 63-187088 | 11/1988 | Japan . |
| 164936 | 6/1921 | United Kingdom . |

*Primary Examiner*—Bernard Roskoski
*Attorney, Agent, or Firm*—Lowe, Price, LeBlanc & Becker

[57] ABSTRACT

A timepiece capable of selectively showing a before-noon display or an after-noon display. A cam (26) is driven by an hour wheel (10) and an intermediate wheel (12) to make one rotation a day in the counterclockwise direction. During before-noon hours, a lever (20) remains in contact with a larger diameter portion forming part of the cam (26). At 12.00 noon, the lever (30) reaches the transition point of the cam where the larger diameter portion merges into a smaller diameter portion. As the cam (26) further rotates in a direction of an arrow (FB), the lever (30) is instantaneously shifted from the larger diameter portion to the smaller diameter portion of the cam (26) by the action of a spring (34). The shift of the lever (30) is transferred to a movable dial plate (36) via a tooth section (31) provided at the end of the lever (30) and a switching groove (39), so that the dial plate (36) is rotated by a predetermined angle in a direction of an arrow (FC). As a result, the timepiece is instantaneously switched from the before-noon display to the after-noon display.

5 Claims, 7 Drawing Sheets

TIMEPIECE AND ITS DISPLAY SWITCHING MECHANISM

FIELD OF THE INVENTION

The present invention relates to a timepiece capable of switching the time display thereof on a before-noon/after-noon basis, and a display switching mechanism thereof.

BACKGROUND OF THE RELATED ART

Among conventional timepieces, a 12-number timepiece is predominant which has an hour hand making two turns a day. Such a timepiece has a dial plate equally divided into twelve and allows the time to be read on the basis of an hours symbol pointed by the hour hand. The problem with this kind of timepiece is that a person cannot distinguish the before-noon and the after-noon at a glance since hours and minutes are displayed by exactly the same symbols both the before-noon hours and the after-noon hours.

In light of the above, some timepieces are provided with an hour hand making a single turn a day in order to display the time on a 24-hour basis. However, since the display area available with a wrist watch, watch or similar portable watch is small, dividing it into twenty-four would render the time difficult to see. Moreover, a person accustomed to a predominant 12-numeral timepiece is apt to mistake the time.

It is, therefore, preferable to preserve the conventional hour hand turning round on a 12-numeral basis and, in addition, to distinguish the before-noon hours and the after-noon hours in a sure and easy way.

A mechanism for switching the time display to distinguish the before-noon and the after-noon, particularly a display switching mechanism for a wrist watch, is taught in Japanese Utility Model Laid-Open Publication No. 63-187088 by way of example. The mechanism disclosed in this Laid-Open Publication has an operating wheel making one rotation a day. An actuator pin is studded on the operating wheel and received in a switching window formed through a display plate. When the actuator pin completes one rotation within the window, the display plate moves a predetermined angle in a reciprocating motion. As a result, the display is switched from the before-noon to the after-noon and vice versa.

In the above mechanism, a jump and hold spring moves along a tooth portion formed in the inner periphery of the display plate and then gets it over, at each transition from the before-noon to the after-noon, and vice versa. This, however, brings about a problem that at the time of display switchover, numerals "1" to "12" representing the before-noon hours and numerals "13" to "24" representing the after-noon hours overlap each other little by little, making it difficult to see the time.

Although the switchover from the after-noon display to the before-noon display may proceed slowly since it generally occurs while a person is asleep, the switchover from the before-noon display to the after-noon display should preferably be sharp.

It is, therefore, an object of the present invention to provide a timepiece having an hour hand moving on a 12-numeral basis like a conventional hour hand, and allowing the before-noon display and the after-noon display to be distinguished surely and easily. Another object of the present invention is to provide a convenient timepiece capable of switching the time display thereof from the before-noon to the after-noon instantaneously, and a display switching mechanism thereof.

DISCLOSURE OF THE INVENTION

In accordance with the present invention, a rotation is transferred from an hour wheel to a sectorial cam via an operating wheel, thereby causing the cam to make one rotation a day. A lever is held in contact with the cam and constantly is biased by a spring. The lever moves in a reciprocating angular motion due to the sectorial shape of the cam. The reciprocation of the lever matches a difference between a larger diameter portion and a smaller diameter portion forming the cam. A movable dial plate is engaged with the lever and, therefore, is also moved in a reciprocating motion. The angular movement and position of the movable dial plate are determined by the reciprocation of the lever.

In the event of a change from the before-noon display to the after-noon display, the lever is shifted from a relatively larger diameter portion to a relatively smaller diameter portion of the cam under the biasing action of the spring, thereby rotating the movable dial plate instantaneously.

The timepiece mechanism stated above causes the movable dial plate to reversibly rotate in the circumferential direction in interlocked relation to an hour hand. At 12.00 noon, the movable dial plate rotates a predetermined angle in, for example, the clockwise direction. As a result, symbols representing 13.00 hours to 24.00 hours show themselves through windows (openings) formed in a dial plate, thereby setting up the after-noon display. As the hour hand reaches 12.00 midnight (24.00 hours), the movable dial plate rotates the predetermined angle in, for example, the counterclockwise direction. Consequently, symbols representing 01.00 hours to 12.00 hours appear through the windows of the dial plate, thereby setting up the before-noon display.

Further, a retainer presses the movable dial plate toward a base plate. Hence, even when vibration acts on the timepiece, numerals provided on the movable dial plate are prevented from being displaced relative to the windows. The timepiece may, therefore, be advantageously implented as a wrist watch, watchor simiilar portable timepiece.

In addition, since the hours symbols themselves are configured to selectively display the before-noon or the after-noon, a person can see the time easily while distinguishing the before noon and the after-noon.

The above and other objects, features and advantages of the present invention will become apparent from the following detailed description taken with the accompanying drawings.

DETAILED DESCRIPTION OF THE PREFERRED EMBODIMENTS

While the present invention is practicable in various modes, an adequate number of embodiments thereof will be shown and described in detail.

Embodiment 1

Figure 1:
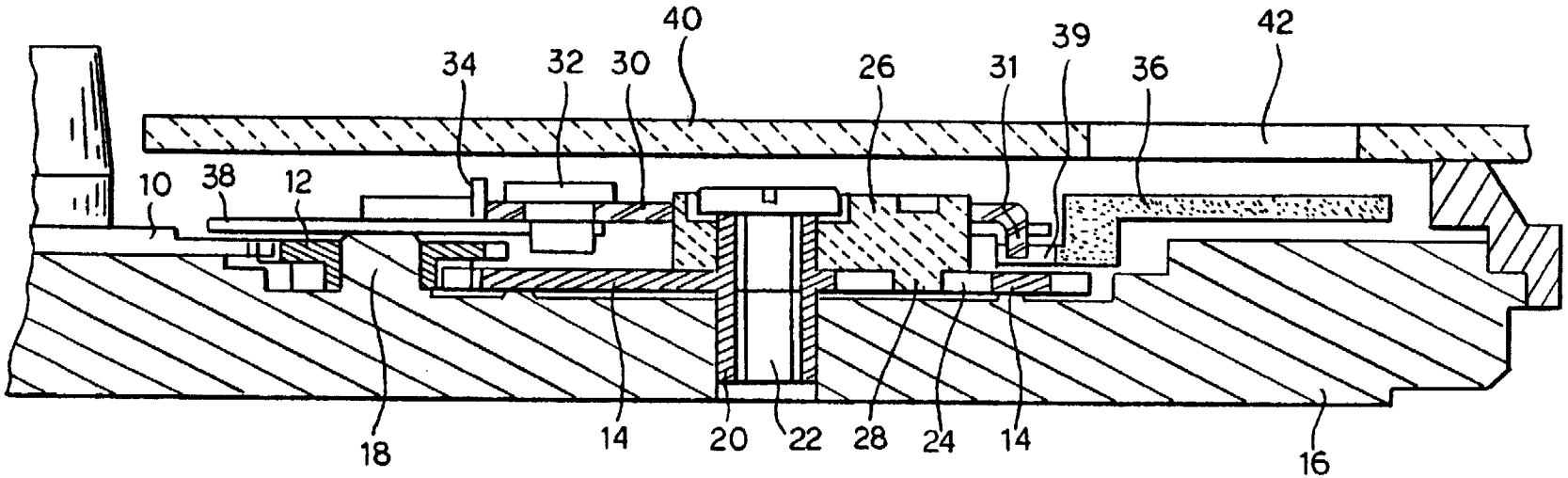
FIG. 1 is a section showing essential part of Embodiment 1 of the display switching mechanism of a timepiece in accordance with the present invention.

FIG. 1 is a section of essential part of Embodiment 1 while FIG. 2 is a plan view of the same. In these figures, a cylindrical hour wheel 10 is positioned at the center of a timepiece. An intermediate wheel 12 is held in mesh with the hour wheel 10 and with an operating wheel 14. The hour wheel 10, intermediate wheel 12 and operating wheel 14 have their respective of teeth, for example, preselected such that the wheel 14 makes one rotation a day. An intermediate wheel 12 is mounted on a shaft 18 which is formed integrally with a base plate 16. The operating wheel 14 is mounted on a shaft 20 which is affixed to the base plate 16 by a screw 22.

The operating wheel 14 is formed with a hole 24. A cam 26 is rotatably supported by the shaft 20 and has a cam pin 28 protruding into the hole 24. In this configuration, when the operating wheel 14 is rotated clockwise, the edge of the hole 24 abuts against the cam pin 28 and thereby causes the cam 26 to rotate in the same direction, i.e., clockwise.

A lever 30 is held in abutment against the cam 26 and freely rotatable about a shaft 32. A spring 34 constantly biases the lever 30 in the clockwise direction. The lever 30 is movable in a reciprocating motion between two positions shown in FIGS. 2(A) and 2(B), i.e., a position where it contacts the larger diameter portion of the cam 26 and a position where it contacts the smaller diameter portion of the same.

A movable dial plate 36 surrounds the mechanical arrangement described above. The dial plate 36 is pressed toward the base plate 16 by a retainer 38 and rotatable about the hour wheel 10. The retainer 38 protects the movable dial plate 36 from displacement when vibrations applied to the timepiece from the outside. Symbols, or characters, 35 are provided on the outer circumferential portion of the dial plate 36 and implemented as numerals "1" to "24" representing hours. The numerals "1" to "12" representing the before-noon hours and the numerals "12" to "24" representing the after-noon hours alternate with each other. A switching groove 39 is formed in the inner circumferential edge of the dial plate 36 at a position corresponding to the end of the lever 30. A tooth section 31 is formed at the end of the lever 30 and received in the switching groove 39. The tooth section 31, acting on the groove 39, causes the dial plate 36 to selectively rotate clockwise or counterclockwise in response to the movement of the lever 30.

A dial plate 40 is positioned on the front of the timepiece and formed with twelve windows 42 at equally spaced locations along the circumference thereof. The windows 42 correspond in position to the previously mentioned numerals 35. The numerals 35 appearing through the windows 42 are changed in order to selectively implement the before-noon display or the after-noon display. Specifically, the numerals "1" to "12" and the numerals "13" to "24" respectively indicate the before-noon hours and the after-noon hours when they appear through the windows 42.

Figure 2A:
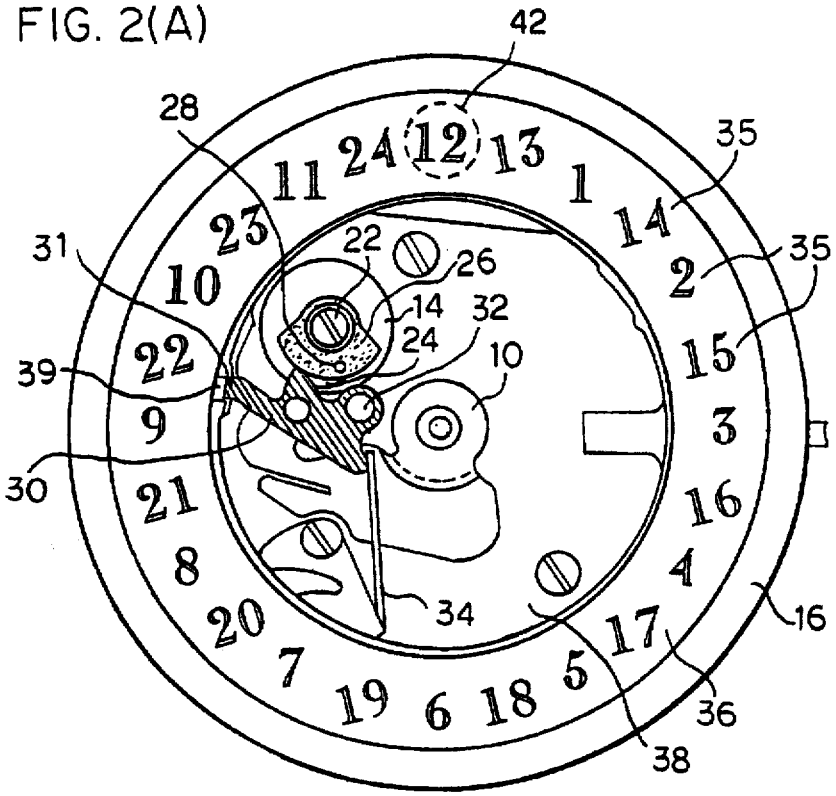
FIGS. 2(A) and 2(B) are plan views showing the essential part of Embodiment 1.
Figure 4A:
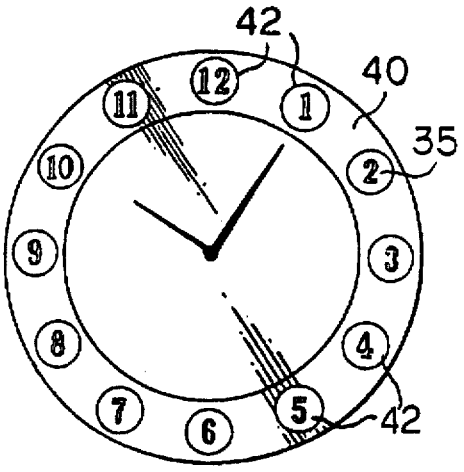
FIGS. 4(A) and 4(B) shows a specific before-noon time and a specific after-noon time.

The operation of Embodiment 1 will be described with reference also made to FIGS. 3(A), 3(B), 4(A) and 4(B). The operating wheel 14 makes one rotation a day due to the operation of the hour wheel 10 and intermediate wheel 12, as stated earlier. At this instant, the hole 24 of the operating wheel 13 rotates with the cam pin 28 abutting against the edge thereof, so that the cam 26 also makes one clockwise rotation a day. During the before-noon hours, the lever 30 remains in contact with the larger diameter portion of the cam 26, as shown in FIG. 2(A). FIG. 4(A) shows a specific before-noon time appearing on the timepiece; the numerals "1" to "12" are visible through the windows 42 of the dial plate 40.

As the time passes from the above condition, the cam 26 is further rotated clockwise. At 12.00 noon, the lever 30, held in the position shown in FIG. 2(A), is moved to a position shown in FIG. 3(A) where it reaches the transition point of the cam 26 where the larger diameter portion merges into the smaller diameter portion. The spring 34 constantly biases the lever 30 in a direction indicated by an arrow FA, as mentioned previously. Hence, as the cam 26 is further rotated in a direction indicated by an arrow FB, the lever 30 is instantaneously shifted from the larger diameter portion to the smaller diameter portion of the cam 26. As a result, the tooth section 31 of the lever 30 is instantaneously moved in a predetermined amount (corresponding to a difference between the larger diameter portion and the smaller diameter portion of the cam 26) in a direction indicated by an arrow FC.

Figure 4B:
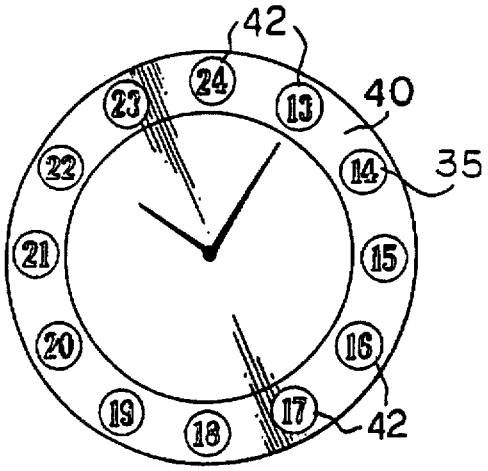

The tooth section 31 is received in the switching groove 39 of the movable dial plate 36, as stated earlier. Consequently, the movable dial plate 36 rotates a predetermined angle in direction FC to a position shown in FIG. 2(B). The timepiece, therefore, shows the after-noon hours thereon, as depicted in FIG. 4(B); the numerals "13" to "24" are visible through the windows 42 of the dial plate 40.

Figure 2B:
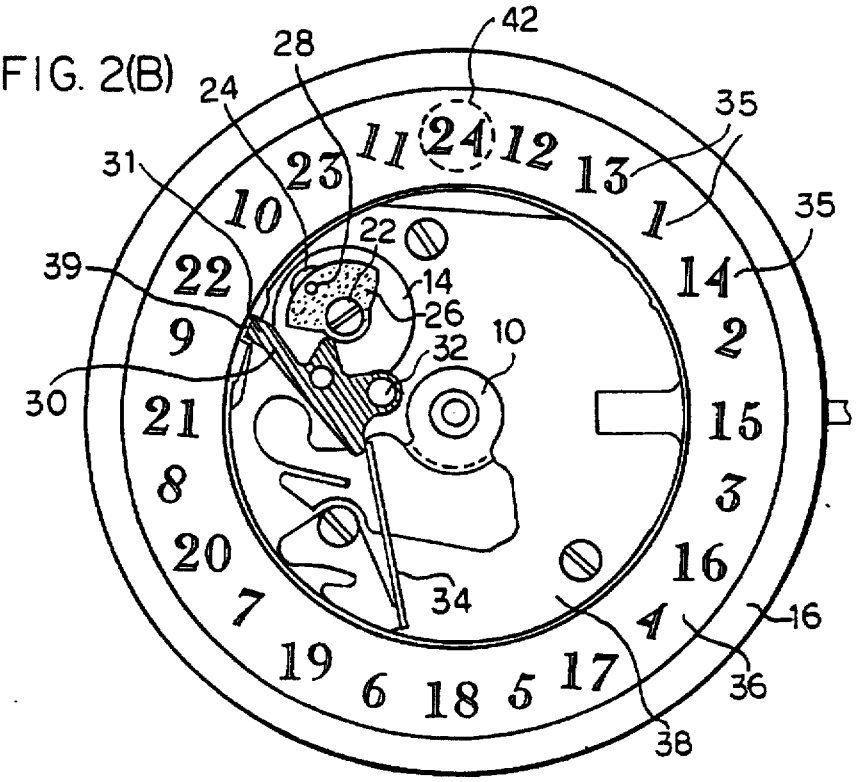
Figure 3A:
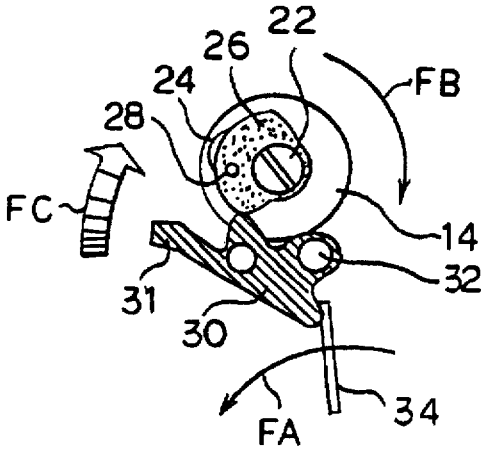
FIGS. 3(A) and 3(B) show how a cam and a lever included in Embodiment 1 move in the event of before-noon/after-noon switchover.
Figure 3B:
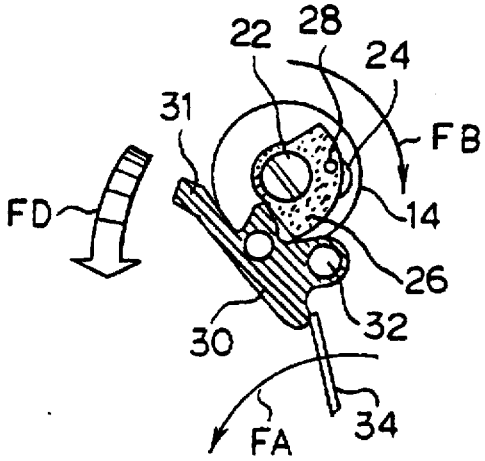

During the after-noon hours, the lever 30 remains in contact with the smaller diameter portion of the cam 26, as shown in FIG. 2(B). In this condition, the after-noon display continuously appears on the timepiece, as depicted in FIG. 4(B). As the time further passes, the cam 26 further rotates clockwise. At 24.00 hours (12.00 noon or midnight), the lever 30, held in the position of FIG. 2(B), is moved to the position of FIG. 3(B) where it reaches the transition point of the cam 26 where the smaller diameter portion merges into the larger diameter portion. The spring 34 constantly biases the lever 30 in the direction FA, as described previously. Hence, on the continued rotation of the cam 26 the direction FB, the lever 30 sequentially shifts from the smaller diameter portion to the larger diameter portion of the cam 26.

Consequently, the tooth section 31 of the lever 30 sequentially moves in a predetermined amount in a direction indicated by an arrow FD, causing the movable dial plate 36 to move a predetermined angle in the direction FD. As a result, the before-noon display appears on the timepiece, as illustrated i n FIG. 4(A); the numerals "1" to "12" are visible through the windows 42 of the dial plate 40.

As stated above, in Embodiment 1, the lever is driven by the larger diameter portion and smaller diameter portion of the sectorial cam. To switch the display from the before-noon to the afternoon, the lever is moved in the direction in which it is biased by the spring. This effects the switchover at 12.00 noon instantaneously and thereby facilitates the confirmation of the time.

Further, the retainer 38 presses the movable dial plate 36. Hence, even when vibration acts on the timepiece, the numerals 35 provided on the movable dial plate 36 are prevented from being displaced relative to the windows 42.

In addition, since the hours symbols 35 themselves are configured to selectively display the before-noon or the after-noon, a person can see the time easily while distinguishing the before-noon and the after-noon.

Embodiment 2

Figure 5:
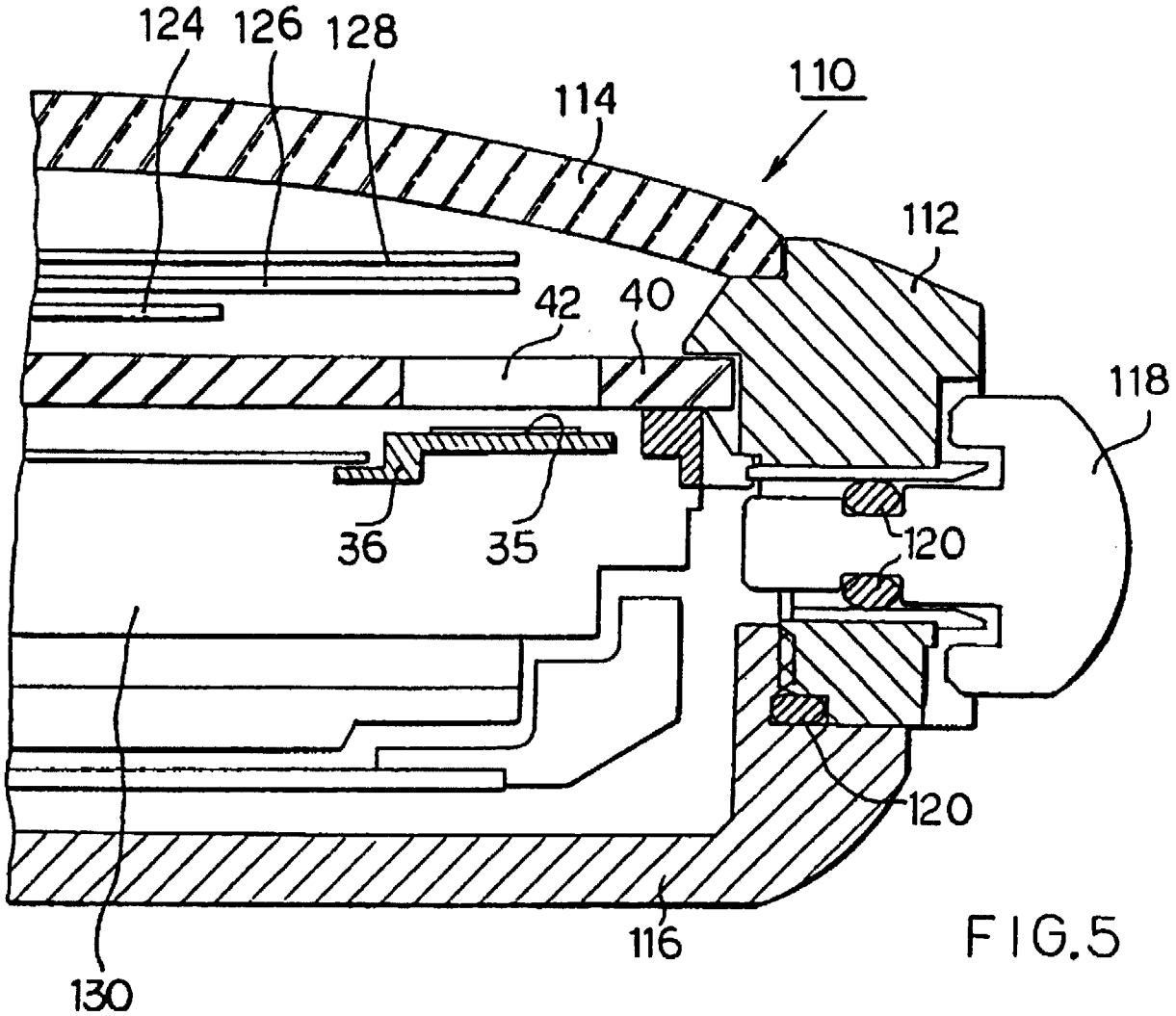
FIG. 5 is a section showing essential part of Embodiment 2 practicable by applying Embodiment 1 to a wrist watch.

Embodiment 2 will be described hereinafter which is practicable by applying Embodiment 1 to a wrist watch. FIG. 5 is a fragmentary section of a watch in accordance with Embodiment 2. As shown, a watch 110 has a case 112, a glass lid 114 covering the front, and a rear cover 116 covering the rear. A crown 118 is provided on the case 112. A packing or seal 120 is disposed between the rear cover 116 and the crown 118 and between the crown 118 and the case 112 for waterproofing and other purposes.

The dial plate 40 is positioned at the front side of the case 112. An hour hand 124, a minute hand 126 and a second hand 128 turn round in the space defined between the dial plate 40 and the glass lid 114. A watch mechanism 130 is interposed between the dial 40 and the rear cover 116 and drives the hands 124, 126 and 128.

The watch mechanism 130 includes the hour wheel 10, intermediate wheel 12, operating wheel 14, base plate 16, cam 26, cam pin 28, lever 30, and spring 34 shown in FIG. 1. The crown 130, acting on the watch mechanism 130, may be operated to set time or for a similar purpose. The dial plate 40 is affixed to the watch mechanism 130.

In this embodiment, the dial plate 40 is also formed with the twelve windows 42 at equally spaced locations along the circumference thereof. The movable dial plate 36, having an annular configuration, is provided with the symbols 35 beneath the windows 42. In this configuration, the symbols 35 of the movable dial plate 36 are visible through the windows 42 of the dial plate 40 and glass lid 114. The movable dial plate 36 is connected to the watch mechanism 130 in such a manner to be reversibly rotatable in the circumferential direction while being intermittently synchronized to the movement of the hands 124, 126 and 128. The operation of the watch mechanism 130 in and that of the movable dial plate 36 are the same as Embodiment 1.

Embodiment 3

Figure 6:
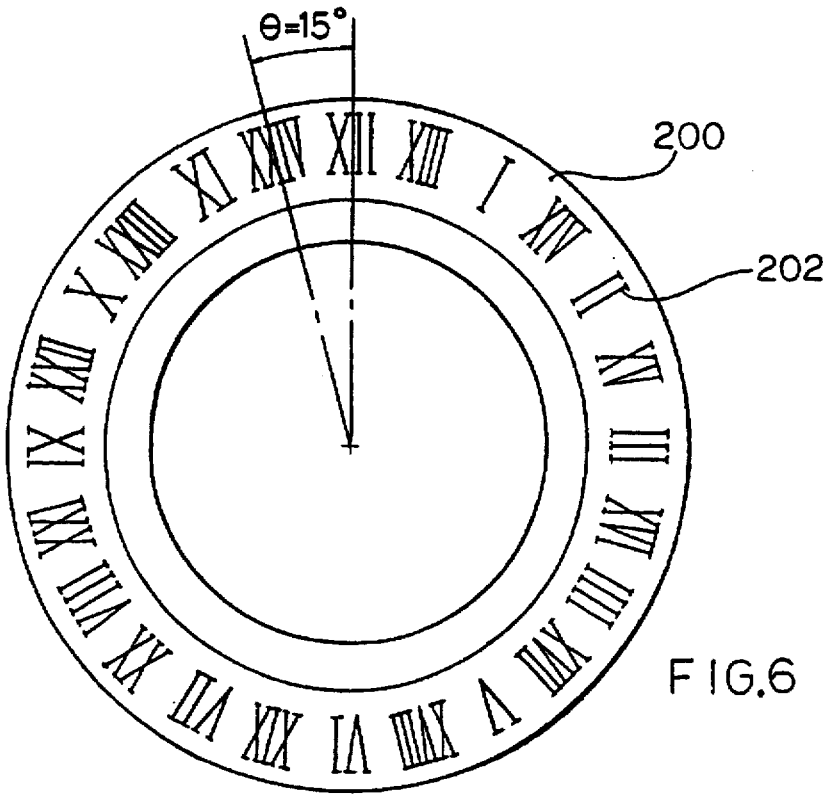
FIG. 6 is a plan view of a movable dial plate included in Embodiment 3.

A reference will be made to FIGS. 6, 7, 8(A) and 8(B) for describing Embodiment 3. Embodiment 3 constitutes an improvement over the previous embodiments as to the dial plate and movable dial plate. FIG. 6 is a plan view of a movable dial plate 200 in accordance with Embodiment 3. As shown, symbols 202 representing hours are implemented as so-called timepiece characters. The movable dial 200 is equally divided by an angle of $\theta=15°$ and has characters "I" to "XII" representing the before-noon hours and characters "XIII" to "XXIV" representing the after-noon hours and which are arranged alternately thereon.

Figure 7:
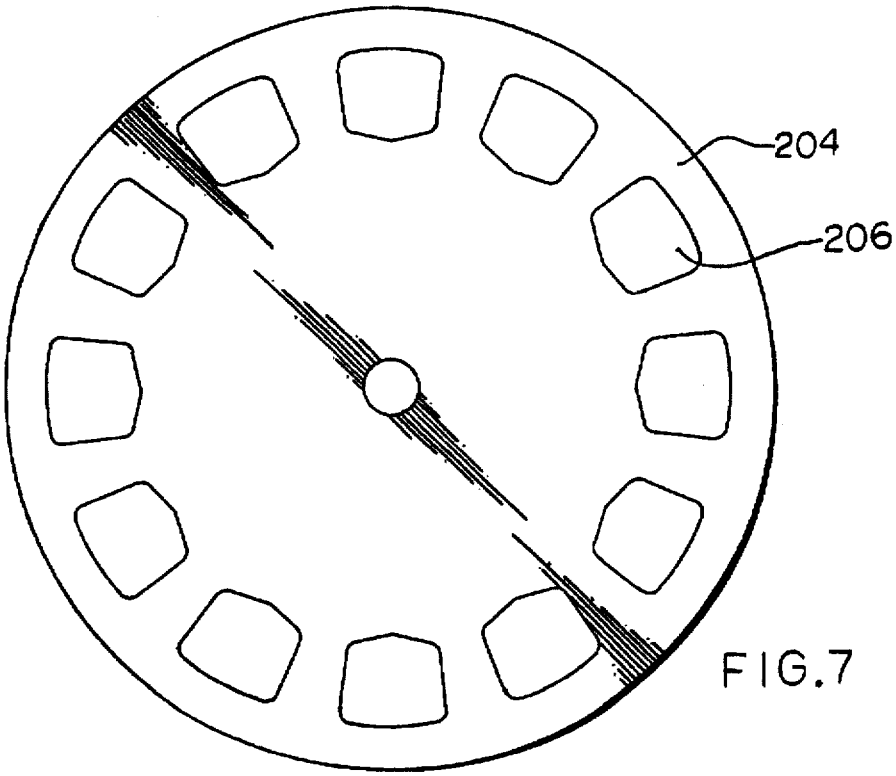
FIG. 7 is a plan view of a dial plate also included in Embodiment 3.

FIG. 7 is a plan view showing a dial plate 204 in accordance with Embodiment 3. The dial plate 204 is formed with twelve windows 206 at equally spaced locations along the circumference thereof. The windows 206 are so located as to show the characters 202 of the movable dial plate 200 therethrough.

Figure 8A:
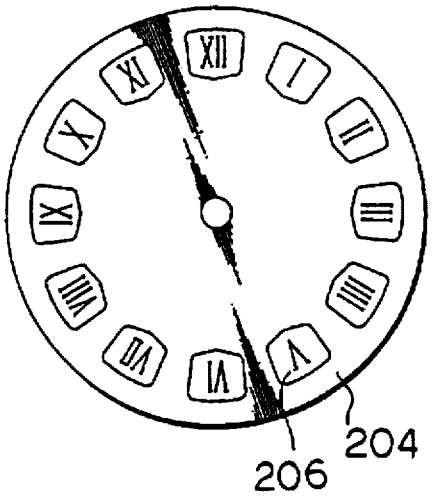
FIGS. 8(A) and 8(B) show a before-noon display and an after-noon display particular to Embodiment 3.
Figure 8B:
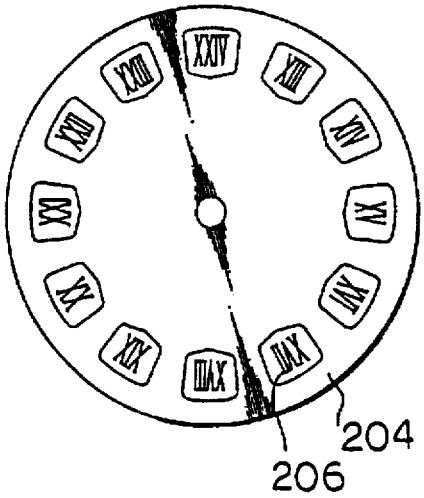

The operation of Embodiment 3 will be described with reference also made to FIGS. 8(A) and 8(B). First, assume that the before-noon hours are shown on the timepiece. In this condition, among the characters 202 of the movable dial plate 200 shown in FIG. 6, "I" to "XII" are visible through the windows 206 of the dial plate 204, as shown in FIG. 8(A). The other characters 200, i.e., "XIII" to "XXIV" are concealed by the dial 204.

At 12.00 noon, the movable dial plate 200 is rotated by $\theta=15°$ clockwise by the wheel train of the watch mechanism 130 (see FIG. 5). As a result, among the characters 202, "XII" and "I" are replaced with "XXIV" and "XIII", respectively. This is also true with the other characters. Specifically, characters "XIII" to "XXIV" representing the after-noon hours are respectively brought to the positions where characters "I" to "XII" representing the before-noon hours have been located. FIG. 8(B) shows the resulting condition visible through the windows 206 of the dial plate 204. In this manner, the timepiece is switched from the before-noon display to the after-noon display.

Subsequently, at 00.00 hours (12.00 midnight), the movable dial plate 200 is rotated $\theta=15°$ counterclockwise by the wheel train of the watch mechanism 130. As a result, characters the "XII" and "I" are respectively brought to the positions where the "XXIV" and "XIII" have been located. This is also true with the other characters.

Specifically, the characters "I" to "XII" representing the before-noon hours are respectively brought to the positions where the characters "XIII" to "XXIV" representing the after-noon hours have been located.

FIG. 8(A) shows the resulting condition visible through the windows 206 of the dial plate 204. In this manner, the timepiece is switched from the after-noon display to the before-noon display.

As stated above, Embodiment 3, like Embodiment 1, causes the movable dial plate 200 to rotate 15° clockwise or counterclockwise intermittently every twelve hours, thereby selectively displaying the before-noon hours or the after-noon hours. Hence, despite that the hour hand 124 moves on a 14-hour basis, the timepiece is capable of displaying the time on a 24-hour basis.

Embodiment 4

Figure 9:
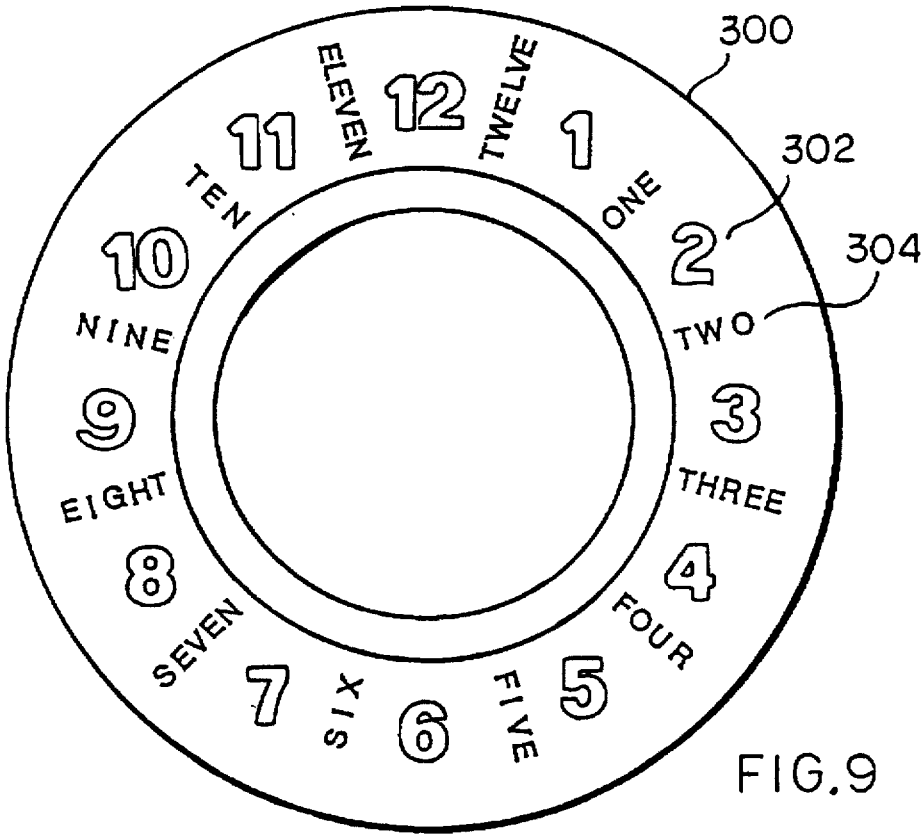
FIG. 9 is a plan view of a movable dial plate included in Embodiment 4.

Embodiment 4 of the present invention will be described hereinafter. As shown in FIG. 9, Embodiment 4 has an improved movable dial plate 300. As shown, one of symbols 302 representing the before-noon hours and after-noon hours are implemented as numerals "1", "2", "3", . . . , "12" while the other characters 304 are implemented as alphabets "ONE", "TWO", "THREE", . . . , "TWELVE".

While Embodiments 1 and 3 shown and described use the same kind of symbols for both of the before-noon display and the after-noon display, Embodiment 4 assigns a particular kind of symbols to each of the before-noon display and the after-noon display. This allows a person to distinguish the before-noon hours and the after-noon hours immediately at a glance.

Embodiment 5

Figure 10:
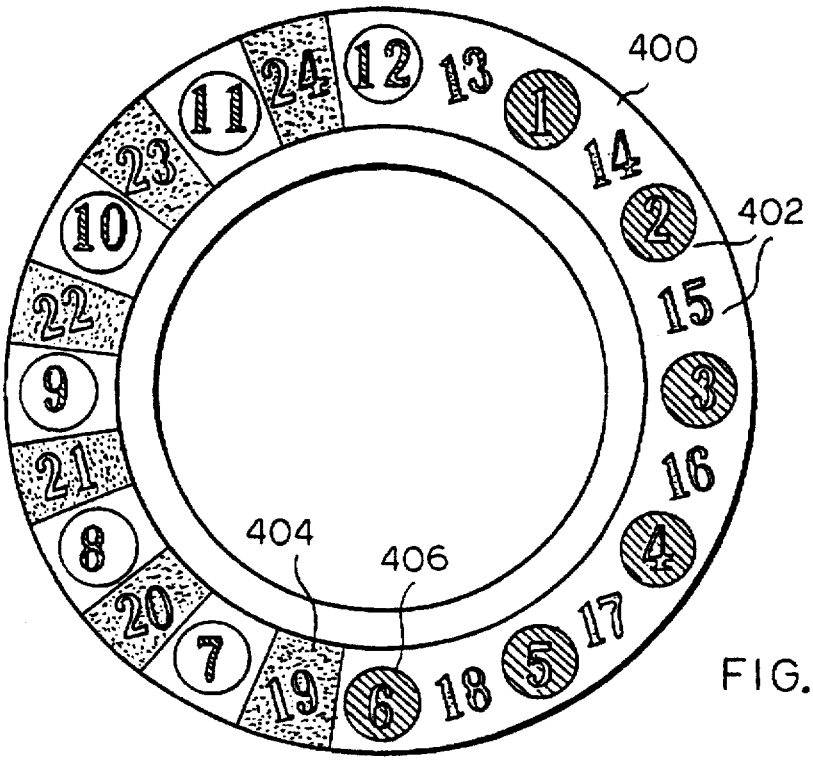
FIG. 10 is a plan view of a movable dial plate included in Embodiment 5.

Embodiment 5 will be described with reference to FIG. 10. This embodiment, like Embodiment 4, has an improved movable dial plate 400. As shown, the movable dial plate 400 has symbols 402 thereon which are generally implemented as serial numerals "1" to "24"; "1" to "12" indicate the before-noon hours while "13" to "14" indicate the after-noon hours. A symbol 404 representing "19" in the evening to a symbol 406 representing "6" at dawn are provided with a dark tone for imaging nighttime.

The symbols of such different tones and imaging the before-noon and the after-noon, respectively, facilitate the distinction between the before-noon and the after-noon.

Embodiment 6

Figure 11:
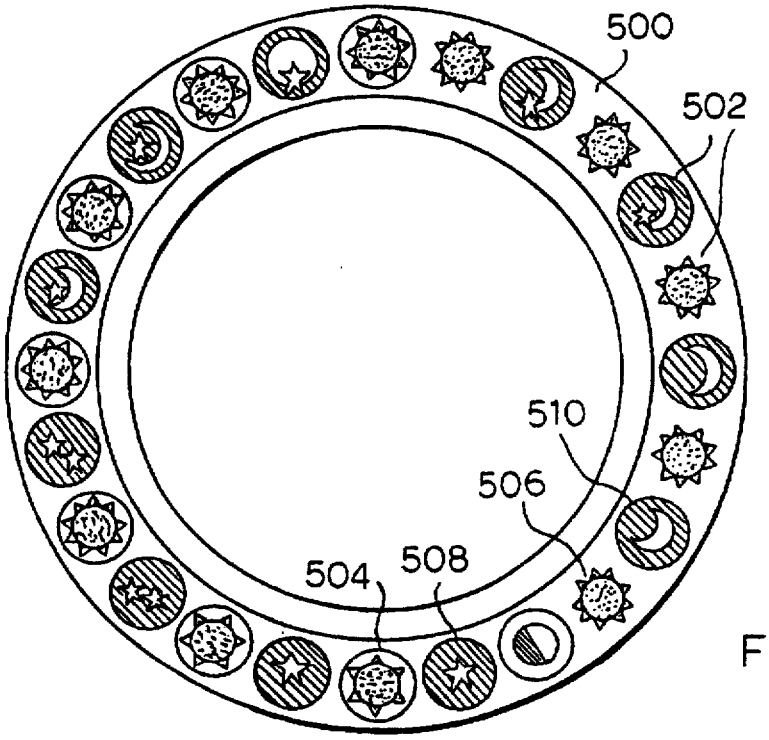
FIG. 11 is a plan view of a movable dial plate included in Embodiment 6.

A reference will be made to FIG. 11 for describing Embodiment 6. In Embodiment 6, a movable dial plate 500 is provided with symbols 502 representing hours. Among the symbols 502, a symbol 504 representing 6.00 at dawn to a symbol 506 representing 17.00 in the evening are implemented as the sun for imaging daytime. A symbol 508 representing 18.00 in the evening to a symbol 510 representing 4.00 at dawn are implemented as the combination of the moon and star imaging nighttime.

Embodiment 6, like Embodiment 5, distinguishes the before-noon and the after-noon with ease on the basis of a visual image.

Other Embodiments

The present invention may be changed or modified in various ways on the basis of the foregoing disclosure. For example, it may be changed or modified as follows.

(1) While the embodiments have been shown and described mainly in relation to a wrist watch, they are similarly applicable to any other portable timepiece, e.g., a watch. The configurations of the various parts included in the switching mechanism may be changed or modified as desired, so long as the advantages stated earlier are attainable therewith.

(2) The symbols representing the before-noon and after-noon may be implemented in a language other than English. The symbols may even be colored or painted with a luminous paint, if desired.

(3) The windows of the dial plate may be provided with a circular, square or similar suitable configuration. The windows may be implemented by lenses in order to display the symbols in an enlarged scale. Further, the windows may be colored or provided with a desired pattern.

In summary, in accordance with the present invention, a movable dial plate so configured as to display the before-noon hours and after-noon hours is built in a timepiece. A wheel train, included in the mechanical body of the timepiece, causes the movable dial plate to selectively rotate clockwise or counterclockwise intermittently in interlocked relation to hands. A dial plate is fixed in place above the movable dial plate and formed with windows overlying the time display portion of the movable dial.

In the above construction, the movable dial plate is rotated at 12.00 noon and 12.00 midnight to show, respectively, symbols representing the before-noon hours and symbols representing the after-noon hours through the windows. Despite that the hour hand of the timepiece turns once for 12 hours as conventional, the timepiece is capable of clearly distinguishing the before-noon and the after-noon from each other. This is desirable for the display of the before-noon and the after-noon on the timepiece.

A lever constantly biased by a spring cooperates with a cam to cause the movable dial plate to move back and forth. Hence, the display is instantaneously changed from the before-noon to the after-noon. Therefore, at daytime (day), the before-noon hours or the after-noon hours can be clearly seen through the windows of the dial plate. This is also desirable for the before-noon display and the after-noon display of the timepiece.

Further, a retainer presses the movable dial plate toward a base plate. Hence, even when vibration acts on the timepiece, numerals provided on the movable dial plate are prevented from being displaced relative to the windows. The timepiece may therefore, be advantageously implemented as a wrist watch, watch or similar portable timepiece.

In addition, since the hours symbols themselves are configured to selectively display the before-noon or the after-noon, a person can see the time easily while distinguishing the before-noon and the after-noon.

Although the present invention has been described and illustrated in detail, it should be clearly understood that the same is by way of illustration and example only and is not to be taken by way of limitation, the spirit and scope of the present invention being limited only by the terms of the appended claims.

We claim:

1. A display switching mechanism of a portable timepiece, comprising:

a movable dial plate having symbols representing before-noon hours and symbols representing after-noon hours arranged alternately on a circumferential portion;

a dial plate formed with a plurality of windows in a circumferential portion thereof for allowing said symbols to be seen through said plurality of windows;

an operating wheel driven via an hour wheel to make one rotation a day;

a cam freely rotatable about an axis of the operating wheel, having a larger diameter portion and a smaller diameter portions, rotatable by interaction with said operating wheel;

a lever for causing said movable dial plate to rotate in a reciprocating motion, said lever being in contact with said cam and operating in correspondence with a rotation of said cam to rapidly shift from said larger diameter portion to said smaller diameter portion on a transition from the before-noon to the after-noon and also to subsequently shift from said smaller diameter portion to said larger diameter portion on a transition from the after-noon to the before-noon;

a spring constantly biasing said lever to maintain contact between the lever and the cam so that said contact moves from said larger diameter portion toward said smaller diameter portion when said transition occurs from said before-noon to said after-noon; and a retainer constantly forcing said movable dial plate toward a base plate such that said movable dial plate is rotatable in a reciprocating motion via said lever, wherein a 12-numeral display appears when said symbols of said movable dial plate are seen through said windows of said dial plate.

2. The display switching mechanism of a portable timepiece according to claim 1, wherein:

said symbols comprise timepiece characters.

3. The display switching mechanism of a portable timepiece according to claim 1, wherein:

one of said symbols representing the before-noon hours and said symbols representing the after-noon hours comprises numerals while the other of said symbols comprises letters.

4. The display switching mechanism of a portable timepiece according to claim 1, wherein:

said symbols comprise symbols imaging the before-noon and symbols imaging the after-noon.

5. The portable timepiece comprising said display switching mechanism according to claim 1.

* * * * *